United States Patent [19]

Hansen

[11] Patent Number: 4,558,793

[45] Date of Patent: Dec. 17, 1985

[54] TAMPER EVIDENT CONTAINER

[76] Inventor: Gerhard Hansen, Heerstrasse 20, 7166 Sulzbach-Laufen 2, Fed. Rep. of Germany

[21] Appl. No.: 671,459

[22] Filed: Nov. 14, 1984

[30] Foreign Application Priority Data

Nov. 15, 1983 [DE] Fed. Rep. of Germany ..... 3341334

[51] Int. Cl.[4] ..... B65D 1/02

[52] U.S. Cl. ..... 215/32; 215/251

[58] Field of Search ..... 215/32, 33, 250, 251, 215/253

[56] References Cited

U.S. PATENT DOCUMENTS 4,171,236 10/1979 Winchell et al. ..... 215/251 X 4,378,891 4/1983 Fowles et al. ..... 215/32

*Primary Examiner*—Steven M. Pollard

*Attorney, Agent, or Firm*—Roylance, Abrams, Berdo & Goodman

[57] ABSTRACT

A container, especially an ampoule, includes a pipette with an externally threaded part and a grip part connected to the container body by threading. The container is thermoplastic and is closed by a break-off cap having a break-off notch. To obtain access to the pipette, the container must be damaged to be opened. When the container is closed, the pipette is completely surrounded by the container.

11 Claims, 2 Drawing Figures

TAMPER EVIDENT CONTAINER

FIELD OF THE INVENTION

The invention relates to a container having a screw cap completely enclosed within a break-off cap and a body.

BACKGROUND OF THE INVENTION

In a conventional container disclosed in DE-OS No. 32 31 859, the screw cap is formed as a threaded plug or a two-part plug arrangement. The break-off cap extends over the largest diameter of the threaded plug or of the part of the plug arrangement lying nearest the container bottom. The break-off notch is located on a part of the container top having a diameter which is as small as possible. After opening the break-off cap, the middle of the rubber threaded plug or the part of the plug arrangement connected tightly with the container is readily accessible providing access to the container contents by a hollow needle or by a bore in a part of the plug arrangement.

A safety seal is disclosed in DE-OS No. 24 60 407 for screw caps on containers. The cross-sectional configuration of the container, when compared with a circle, has at least one outwardly extending projection, e.g., is gradratic in cross section. The safety seal comprises a special member having upper and lower safety elements connected with each other through safety break points. An inwardly projecting flange is provided on the upper portion of the lower safety element and extends toward the lower end of the upper safety element. The upper safety element engages an internally threaded screw cap, which screw cap engages external threads on the container. Since the lower safety element of the safety seal is prevented by its engagement with the container from rotating, and since the safety seal rests tightly on the closed container, the screw cap can be removed only when the two safety elements are separated from each other in the area of the safety break points.

SUMMARY OF THE INVENTION

An object of the present invention is to provide a container with a break-off cap which can be easily and inexpensively manufactured by a sterile blow molding process, without special sterilization operations for inserting an item, such as a pipette, in the container.

Another object of the present invention is to provide a container with a screw cap which is tamper evident.

The foregoing objects are basically obtained by a container comprising a body having an internally threaded portion, a break-off cap formed as a unitary portion of the body, a break-off notch between the body and the break-off cap, and a screw cap having an externally threaded part threadedly engaged with the body internally threaded portion. The screw cap is completely surrounded by the break-off cap and the body, and has a grip part fixed to the threaded part and a cylindrical part between the threaded part and the grip part laterally adjacent the break-off notch.

By forming the container in this manner, a specially configured screw cap can be mounted in the top of the container which has its largest diameter part removable from the container. The special screw cap can comprise the grip part of a pipette which is integrated into the container. The container and the grip part on the pipette must then be suitably coupled to each other for permitting removal of the grip part from the container and recoupling. The grip part of the pipette can be removed in a simple manner following removal of the break-off cap.

The use of the pipette in the container is advantageous since the container can be manufactured by a sterile blowing molding process without special sterilization operations upon introduction of a sterile pipette. During manufacture of the container, at least the threaded part on the grip part of the pipette is advantageously used as a core for the production of the internal threading in the container neck.

After opening the break-off cap, the grip part connected with the pipette can be unthreaded from the container. The container can be reclosed by the grip part and the pipette. Since the pipette with grip part must be removed completely from the container, the diameter of the break-off notch is determined according to the largest diameter of the part of the pipette found in the contaier, i.e., according to its grip part dimensions. In order to be able to open a break-off cap of such large diameter without a tool, the container material must be quite thin in the area of the break-off notch. The thin material at the break-off notch is provided by use of the circular cylindrical shell part on the grip part.

A lateral space can be provided between the screw cap and the break-off cap. This space facilitates opening opening of the break-off cap.

The material of the screw cap preferably has a higher melting point than the melting point of the material of the body and the break-off cap. This prevents the container and the grip part of the pipette, if they are thermoplastic, from being melted together during the container manufacturing process and forming a melt connection. The melt connection could prevent the opening of the break-off cap and/or removal of the pipette from the container.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT

Figure 1:
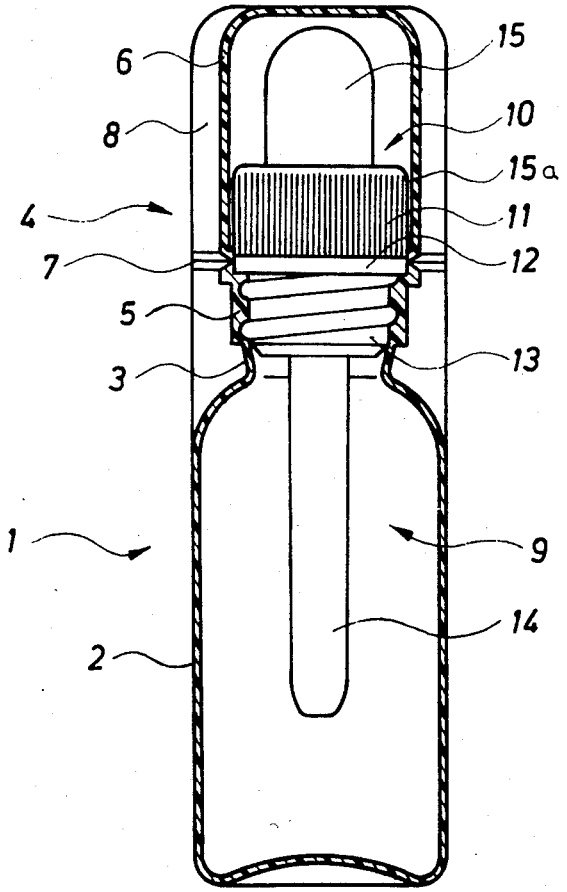
FIG. 1 is a side elevational view in section of a container according to the present invention.
Figure 2:
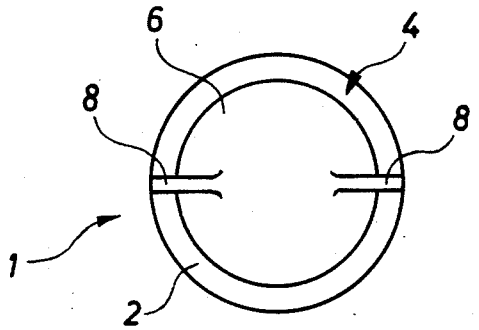
FIG. 2 is a top plan view of the container of FIG. 1.

A plastic container 1 according to the present invention is manufactured, filled and closed in one work process. Container 1 comprises a container body 2 to hold material, especially eye drops. The body is swaged at the top and progresses into an upwardly flared conical container neck 3. Above container neck 3, a container top 4 is provided with an internally threaded part 5 and a break-off cap 6. A break-off notch 7 is arranged between part 5 and break-off cap 6, and flares outwardly. Cap 6 has wing-like flanges 8 extending radially on its opposite sides for distances corresponding to the transverse diameter of the container body. Flat flanges 8 serve as handles and extend from cap 6 to the top of the container body. Break-off notch 7 also extends through flanges 8.

Container 1 completely surrounds a pipette 9. The pipette has a grip part 10, which has a serrated grip portion 11, a circular cylindrical shell part 12 and an externally threaded part 13. Part 13 threadedly engages the internal threading of threaded part 5 of container 1. A small glass tube 14 extends downwardly from grip part 10 and is narrowed at its bottom end. At its top widened end, the glass tube has a rubber top 15.

Between serrated grip portion 11 and break-off cap 6 of container top 4, a space 15*a* is provided. Cap 6 contacts shell part 12 of grip part 10 in the area of break-off notch 7. Break-off notch 7 is preferably located near serrated grip portion 11. Externally threaded part 13 projects radially inwardly from shell part 12. The external threading directly contacts the shoulder which is formed. Container neck 3 tapers downwardly to a diameter which is smaller than the core diameter of externally threaded part 13.

A manufacturing mold is used to produce container 1, which mold has a bottom mold part extending up to internally threaded part 5. The container top part is manufactured by a top mold jaw which has flexibly or resiliently supported top mold parts, in contrast to traditional partial top mold jaws. The flexibly supported top mold parts normally close earlier than the traditional top parts during manufacture of the container top.

Container 1 is manufactured from an extruded tube by a blowing molding process, wherein container body 2 and container neck 3 are formed first and container body 2 is then filled with contents. Subsequently, the pipette is mounted on the top part of container neck 3 and the top mold jaw of the manufacturing mold closes. The flexibly supported mold parts first engage the part of the still heat-sealable plastic tube intended for internally threaded part 5 to contact threaded part 13 of grip part 10 of pipette 9. The break-off notch 7 is also formed at this time. After complete closing of the top mold parts, cap 6 is produced using vacuum pressure and closing container 1 at the top.

Container 1 can be opened only by destruction of break-off notch 7 to permit access to pipette 9 and its removal from container 1. The opening of container 1 is readily recognizable by the broken break-off notch 7. Thus, it is not possible to tamper with the contents without damage to the container.

After its first removal, pipette 9 is easily detached from the threaded part of container 1. Externally threaded part 13 of the pipette is slightly conical and tapers toward small glass tube 14. A radius or a slant or bevel is preferably provided on the lower end of threaded part 13 so that pipette 9 with its threaded part 13 can be mounted on threaded part 5 of container 1 and threadedly coupled more simply.

The exemplary embodiment is an ampoule for eyedrops and is illustrated approximately on a 2:1 scale.

While a particular embodiment has been chosen to illustrate the invention, it will be understood by those skilled in the art that various changes and modifications can be made therein without departing from the scope of the invention as defined in the appended claims.

What is claimed is:

1. A container, comprising:

a body having an internally threaded portion;

a break-off cap formed as a unitary portion of said body;

a break-off notch between said body and said break-off cap; and a screw cap having an externally threaded part threadedly engaged with said internally threaded portion, said body being molded about said externally threaded part to form said internally threaded portion, said screw cap being completely surrounded by said break-off cap and said body and having a grip part fixed to said threaded part and a cylindrical part between said threaded part and said grip part laterally adjacent said break-off notch.

2. A container according to claim 1 wherein said break-off cap is laterally spaced from said grip part of said screw cap.

3. A container according to claim 2 wherein said grip part has a lateral surface which is roughened.

4. A container according to claim 2 wherein said screw cap is formed of a material having a higher melting point than the melting point of said body and said break-off cap.

5. A container according to claim 1 wherein said screw cap is formed of a material having a higher melting point than the melting point of said body and said break-off cap.

6. A container according to claim 1 wherein said screw cap comprises a pipette.

7. A container according to claim 1 wherein said break-off notch is formed in a cylindrical portion of said body extending along an axis coaxial with longitudinal axes of break-off cap and said body.

8. A container according to claim 7 wherein said break-off notch opens in a radially outward direction relative to said axes.

9. A container according to claim 7 wherein said cylindrical portion engages said cylindrical part of said screw cap.

10. A container according to claim 1 wherein said beak-off notch is formed in a cylindrical portion of said body coaxial with said cylindrical part of said screw cap.

11. A container according to claim 10 wherein said cylindrical portion engages said cylindrical part of said screw cap.

* * * * *